US005860373A

United States Patent [19]

Beyer et al.

[11] Patent Number: 5,860,373

[45] Date of Patent: Jan. 19, 1999

[54] MODULE FOR TUFTING TOOLS

[75] Inventors: Walter Beyer, Eschweiler; Christian Jungbecker; Karl-Heinz Schröder, both of Aachen, all of Germany

[73] Assignee: Jos. Zimmermann GmbH & Co. KG, Aachen, Germany

[21] Appl. No.: 702,566

[22] PCT Filed: Feb. 23, 1995

[86] PCT No.: PCT/DE95/00234

§ 371 Date: Nov. 4, 1996

§ 102(e) Date: Nov. 4, 1996

[87] PCT Pub. No.: WO95/23253

PCT Pub. Date: Aug. 31, 1995

[30] Foreign Application Priority Data

Feb. 28, 1994 [DE] Germany ..... G 94 03 286.6
Oct. 6, 1994 [DE] Germany ..... G 94 16 104.6

[51] Int. Cl.[6] ..... D05C 15/10

[52] U.S. Cl. ..... 112/80.45

[58] Field of Search ..... 112/226, 163, 112/80.01, 80.4, 80.45

[56] References Cited

U.S. PATENT DOCUMENTS

| | | | |
|---|---|---|---|
| 4,170,949 | 10/1979 | Lund . | |
| 4,483,261 | 11/1984 | Green et al. . | |
| 5,158,028 | 10/1992 | Beyer | 112/80.45 |
| 5,396,852 | 3/1995 | Bardsley | 112/80.45 |

FOREIGN PATENT DOCUMENTS

| | | |
|---|---|---|
| 8535667 | 2/1986 | Germany . |
| 4400240 | 7/1994 | Germany . |

*Primary Examiner*—Ismael Izaguirre
*Attorney, Agent, or Firm*—Shook, Hardy & Bacon LLP

[57] ABSTRACT

In a module with tufting tools, especially needles the tufting tools are cast with one end in a plate-shaped base The length of the base corresponds to a multiple of the center distance of the cast-in tufting tools. The base has at least one opening which is in the form of a slot running perpendicular to the locating strip(s), which is open to the upper edge of the base. The base can be of symmetrical design and have a locating strip both at its front and at its rear locating face, serving to precisely position the module on a bar. The module and thus also the tufting tools cast into it can thus be used in two different rotational positions.

3 Claims, 4 Drawing Sheets

Fig. 1.
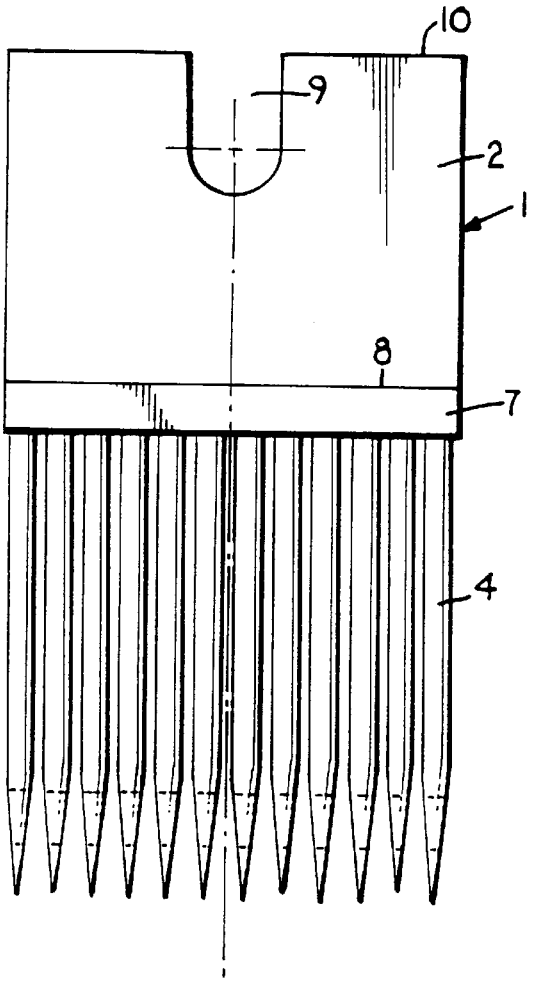
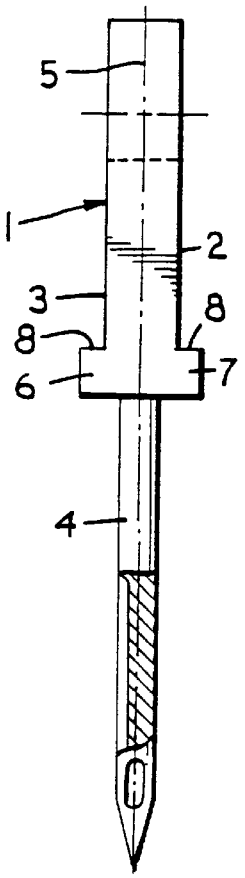
Fig. 2.

Fig. 3.
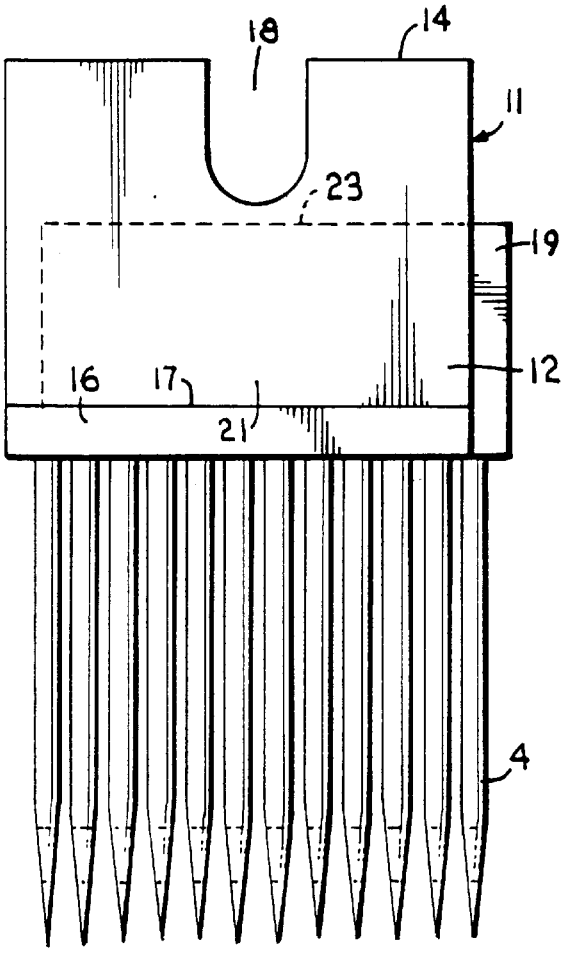
Fig. 4.
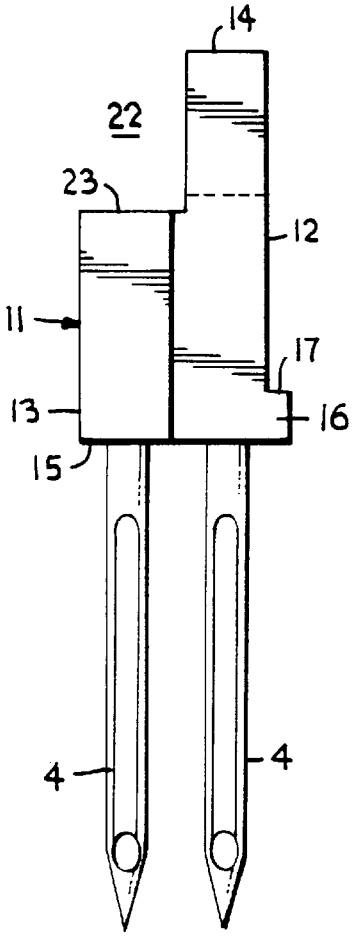
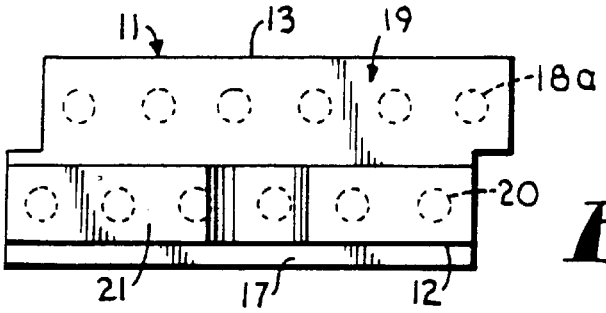
Fig. 5.

Fig.9.
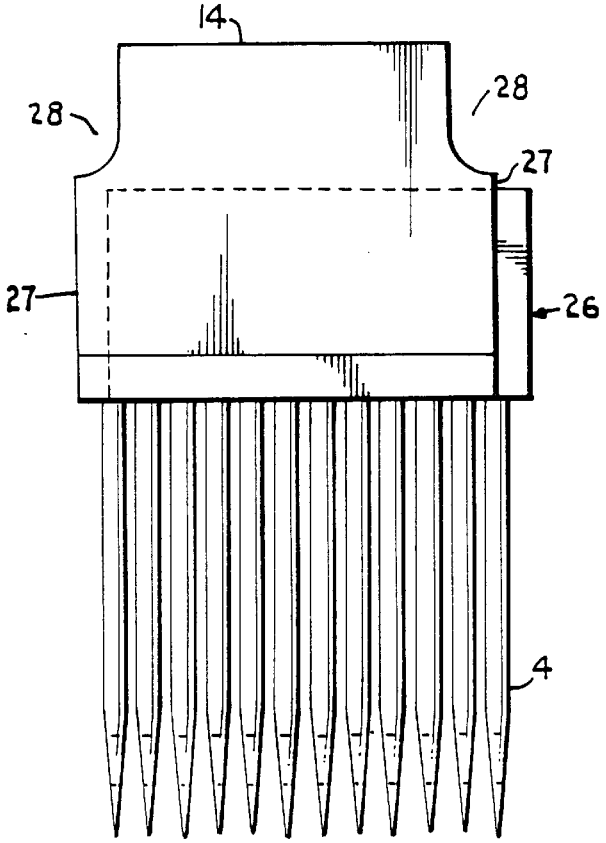
Fig.10.
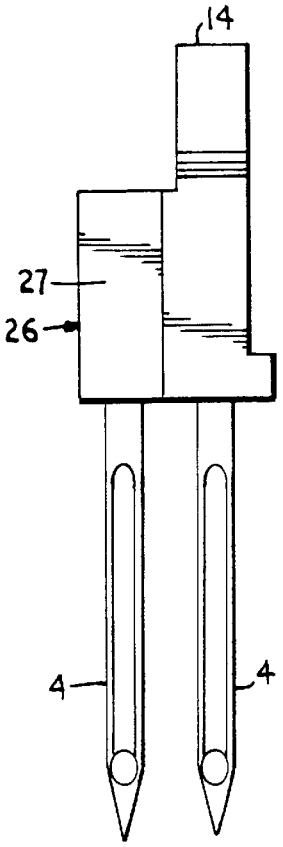
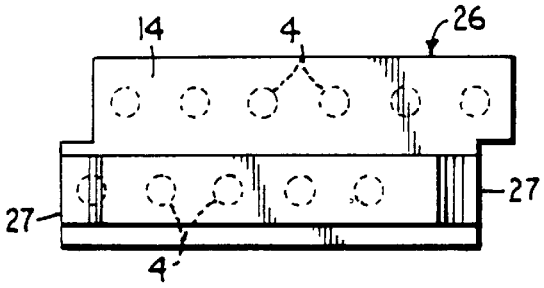
Fig.11.

MODULE FOR TUFTING TOOLS

BACKGROUND OF THE INVENTION

The innovation relates to a module for tufting tools, especially needles, in which the tufting tools are cast at one end in a plate-shaped base, the length of which is a multiple of the center distance of the cast-in tufting tools, which has one front and one rear locating face, the front locating face being fitted with a protruding locating strip at its edge (which runs in a longitudinal direction out of the base in the area of the tufting tools outlet), and which has a continuous opening between the front and the rear locating face.

Such a module for a tufting machine is known in the art from EP 0 446 215. In this known module the base has a locating strip on its front side which when fitted rests against a needle bar or a part of it, enabling precise alignment of the module relative to the needle bar. This needle module can thus only be fixed in one orientation to the needle bar. The tufting tools contained in such a module can accordingly also only be used in one rotational position to the bar. Thus if it is necessary to use the tufting tools in another rotational position relative to the bar shifted through 180°, then it is necessary to use modules in which the rotational position of the needles is altered accordingly. Two types of modules then have to be kept available in which the rotational positions of the tufting tools are 180° opposed to each other. This requires various modules to be kept available, and is consequently costly.

Each base is then provided with an opening in the form of a continuous hole through which a bolt can be passed to fix the module to the bar or suchlike. The use of such a module and its removal requires that the bolt is first completely removed from the hole for this purpose.

SUMMARY OF THE INVENTION

The task to which this innovation relates is in particular to create a module which is of simple construction and can be easily and quickly installed and removed.

This task is performed in the innovation disclosed in a module of the type mentioned above by the opening being formed by at least one section running from the top edge of the base.

The result of this is that it is no longer necessary to completely remove bolts from openings in the modules to install and remove such a module. It is sufficient to slightly slacken such bolts. The modules can then be removed from their installation position or be replaced in their installation position. The number of openings is freely selectable depending upon the particular circumstances.

The module in the innovation disclosed can be so designed that the section has the shape of a slot open at one end.

The module in the innovation disclosed can also be so designed that the section is continuously open to one side edge of the base. A section open to the side edge is expediently provided on both side edges of the base. These sections can accommodate a screw for fixing the module. The sections can be in the form of a slot when two adjacent modules act together, through which a screw can be inserted in order to fix two modules each in the area of a side edge in this way. Each module is expediently retained in the same way at both side edges.

The module in the innovation disclosed can also be so designed that it has at least two rows of tufting tools arranged in parallel, with the tools in one row offset to those in the neighboring row. In this way finer divisions can be achieved in the tufting process.

The module in the innovation disclosed can also be so designed that the tufting tools of the various rows are arranged in one common one-piece base.

The module in the innovation disclosed can also be so designed that the tufting tools are arranged in segments which are separably linked together forming a base.

Finally the module in the innovation disclosed can be so designed that the base also has a locating strip at its rear locating face. This configuration can enable the tufting tools cast in the module to be used in either of two positions opposed at 180° to each other. In this way the number of tools required can be halved compared to what has until now in practice been required for this purpose.

BRIEF DESCRIPTION OF THE DRAWINGS

In the following part of this description some variants of the module disclosed in the innovation are described with the aid of drawings. These show:

FIG. 1 view of the front locating face of a module in the innovation disclosed fitted with tufting needles, FIG. 2 side view of the module in FIG. 1, FIG. 3 view of the front locating face of another module in the innovation disclosed with two rows of tufting tools, FIG. 4 side view of the module in FIG. 3, FIG. 5 top view of the module in FIGS. 3 and 4, FIG. 6 view of the front locating face of another module in the innovation disclosed with two rows of tufting tools and two slots, FIG. 7 side view of the module in FIG. 6, FIG. 8 top view of the module in FIG. 6 and 7, FIG. 9 view of the front locating face of another module in the innovation disclosed, each with a section on the two side edges, FIG. 10 side view of the module in FIG. 9 and FIG. 11 top view of the module in FIGS. 9 and 10.

DETAILED DESCRIPTION OF THE PREFERRED EMBODIMENTS

Figure 6:
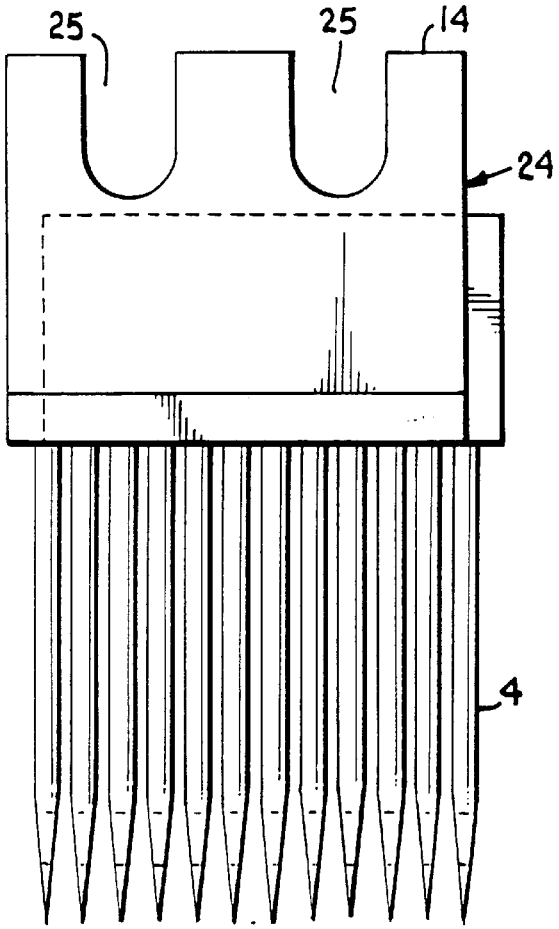

The module shown in FIGS. 1 and 2 has a base 1 with a front locating face 2 and a rear locating face 3 running parallel to it. The plungers of tufting needles 4 are cast in the base 1.

The base 1 is symmetrically designed to form a plane of symmetry 5 running centrally between the front locating face 2 and the rear locating face 3. In the area in which the tufting needles 4 emerge from the base 1 it has a locating strip each 6, 7 projecting opposite the two locating faces 2, 3. These locating strips 6, 7 each have a locating shoulder 8 which is attached in the assembled condition to a needle bar or part thereof, thus aligning the module relative to the needle bar.

The axes of the tufting needles 4 ran parallel to each other in the plane of symmetry 5 of the base 1.

The base 1 has a slot 9 which extends perpendicular to the locating strips 6, 7. It is open at the edge 10 of the base 1, located opposite to the locating strips 6, 7. The slot 9 extends from the front locating face 2 to the rear locating face 4. This enables the base 1 and thus the whole module in the area of the slot 9 to be pushed onto the shaft of a bolt or suchlike, or to be withdrawn from it.

Due to the symmetrical design described, this module can be fixed to a bar in two rotational positions, with the rotational position of the needles changing accordingly.

The design of the module in the innovation disclosed described in FIGS. 3 to 5 has two parallel rows of tufting needles 4, also called segments 19, 21 which are offset to each other by half a division. The front segment 21 has a base 11, a slot 18, a front locating face 12, a rear body surface 13, an upper edge 14 and a lower edge 15. Rear segment 19 has the base 11, a front body surface, a rear body surface 13, and the lower edge 15. At the lower edge 15 of the front locating face 12 there is a locating strip 16 which forms a shoulder 17 with the front locating face 12.

A slot 18 open at the top runs centrally from the upper edge 14.

The above-mentioned offset of the two rows of needles 18*a*, 20 provided in this variant makes it necessary for the base 11, (as shown in particular in FIGS. 3 and 5,) to be offset relative to the front segment 21 accommodating the front row of needles 20, and perpendicular to the needle axes into a rear segment accommodating the rear row of needles 18*a*.

The bases 11 so formed can be arrayed in any number, with the distance between needles in each row remaining the same across the dividing line between neighboring modules.

Base 11 forms a shoulder 23 which can be used as a stop face.

Figure 7:
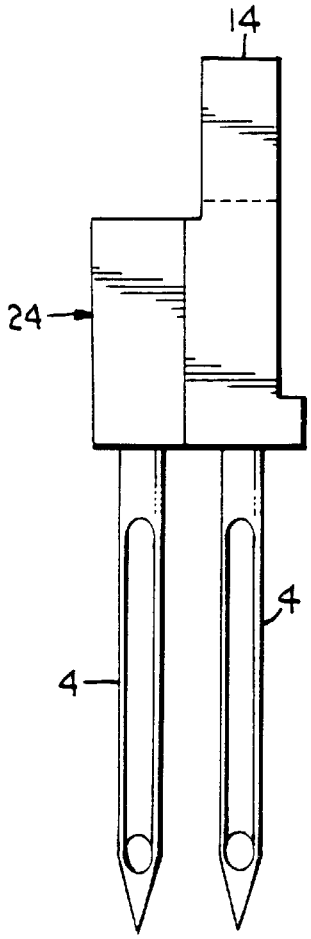
Figure 8:
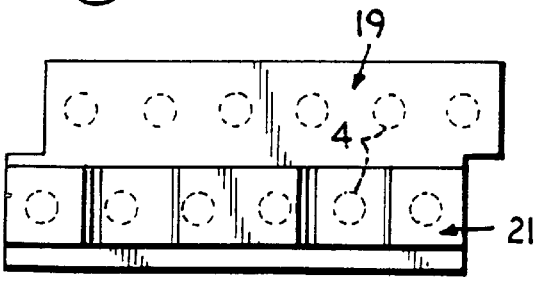

The module in the variant in FIGS. 6 to 8 differs from the variant in FIGS. 3 to 5 only in that in this case there are two parallel slots 25 in one base 24 which are open to the upper edge 14.

The variant shown in FIGS. 9 to 11 of the module disclosed in the innovation differs from the variants described above with reference to FIGS. 3 to 8 only in that in this case there is a base 26 which has open sections 28 starting from its upper edge 14 going through to the side edges 27. If modules of this variant are now arrayed, sections 28 of neighboring modules then combine to form one slot. A bolt passed through such a slot then acts simultaneously on both the contiguous modules. Each module is expediently held on to its two side edges by a bolt, and this bolt in turn acts at the same time on two neighboring modules.

The variants described were represented and described only in combination with tufting needles. Instead of needles other tufting tools can however also be used, especially loopers and grippers.

We claim:

1. A tufting tool module comprising:

a base including opposed upper and lower edges, an opening extending into the base from the upper edge, and opposed front and back locating faces that together define a plane of symmetry located centrally between the faces, each locating face including a locating strip that is symmetrical to the locating strip included on the other face; and a plurality of tufting tools protruding from the lower edge of the base and extending in a direction parallel to one another and perpendicular to the locating strips.

2. A tufting tool module comprising:

a base including front and rear segments, the front segment presenting opposed upper and lower edges, an opening extending into the front segment from the upper edge, a front locating face extending between the upper and lower edges, and a locating strip extending along the front locating face adjacent the lower edge, the rear segment of the base presenting opposed upper and lower edges, wherein the upper edge of the rear segment is spaced from the upper edge of the front segment, the opening extending into the front segment by a distance less than the distance of the spacing between the upper edges of the front and rear segments; and a plurality of tufting tools protruding from the lower edge of each segment of the base and extending in a direction parallel to one another and perpendicular to the locating strip, the tufting tools protruding from the front segment being staggered relative to the tufting tools protruding from the rear segment in a direction parallel to the locating strip.

3. A module as recited in claim 2, wherein said body segments are unitary.

* * * * *